US007900285B2

(12) United States Patent
Steszyn et al.

(10) Patent No.: US 7,900,285 B2
(45) Date of Patent: Mar. 8, 2011

(54) PROTECTIVE CUP AND METHOD OF MANUFACTURING THE PROTECTIVE CUP

(75) Inventors: Michael Steszyn, Portland, OR (US); Simon Luthi, Lake Oswego, OR (US)

(73) Assignee: Under Armour, Inc., Baltimore, MD (US)

( * ) Notice: Subject to any disclaimer, the term of this patent is extended or adjusted under 35 U.S.C. 154(b) by 529 days.

(21) Appl. No.: 11/742,866

(22) Filed: May 1, 2007

(65) Prior Publication Data

US 2008/0271229 A1 Nov. 6, 2008

(51) Int. Cl.
*A41D 27/26* (2006.01)

(52) U.S. Cl. ..... 2/466

(58) Field of Classification Search ..... 2/403, 2/455, 466; 602/72; 128/98.1, 99.1, 89.1
See application file for complete search history.

(56) References Cited

U.S. PATENT DOCUMENTS

| | | | | |
|---|---|---|---|---|
| 849,471 | A * | 4/1907 | Gamble | 602/72 |
| 4,257,414 | A * | 3/1981 | Gamm et al. | 602/72 |
| 5,479,942 | A * | 1/1996 | DiMatteo | 128/846 |
| 5,557,804 | A * | 9/1996 | Ovortrup et al. | 2/23 |
| 6,319,219 | B1 | 11/2001 | Landi | |
| D528,702 | S | 9/2006 | Wong | |
| 7,178,176 | B1 * | 2/2007 | S-Cronenbold | 2/466 |
| 7,296,307 | B2 * | 11/2007 | Atwater et al. | 2/466 |
| 2003/0163076 | A1 | 8/2003 | Lukens | |
| 2005/0268387 | A1 | 12/2005 | Wong | |
| 2008/0201829 | A1 | 8/2008 | Wang | |

* cited by examiner

*Primary Examiner*—Tejash Patel
(74) *Attorney, Agent, or Firm*—Maginot, Moore & Beck

(57) ABSTRACT

A protective cup includes a cage member and a peripheral lip. The cage member includes upper, lower, and side portions. The upper portion may include a plurality of slots. At least one slot may be oriented so that a direction defined by a largest dimension of the at least one slot extends toward one or more of the lower portion and the side portions. The cup may also include linking portions. The lip is operatively connected to the upper and lower portions. The lip may be operatively connected to the side portions or it may be distanced from the cage member at openings between the lip and side portions. If the lip is distanced from the cage member, the linking portions operatively connect the lip to the side portions to fill the openings or one or more parts of the openings. A method of manufacturing the cup is also disclosed.

46 Claims, 12 Drawing Sheets

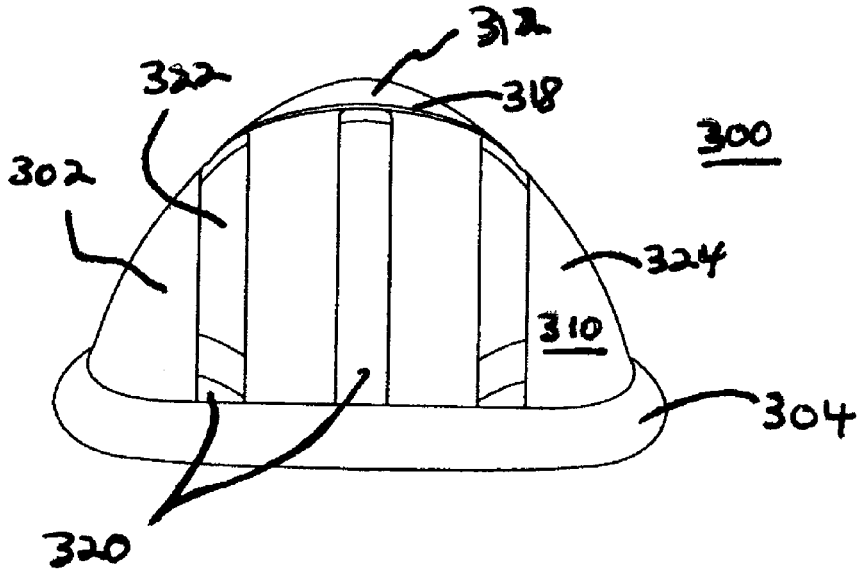
*Fig.* 16
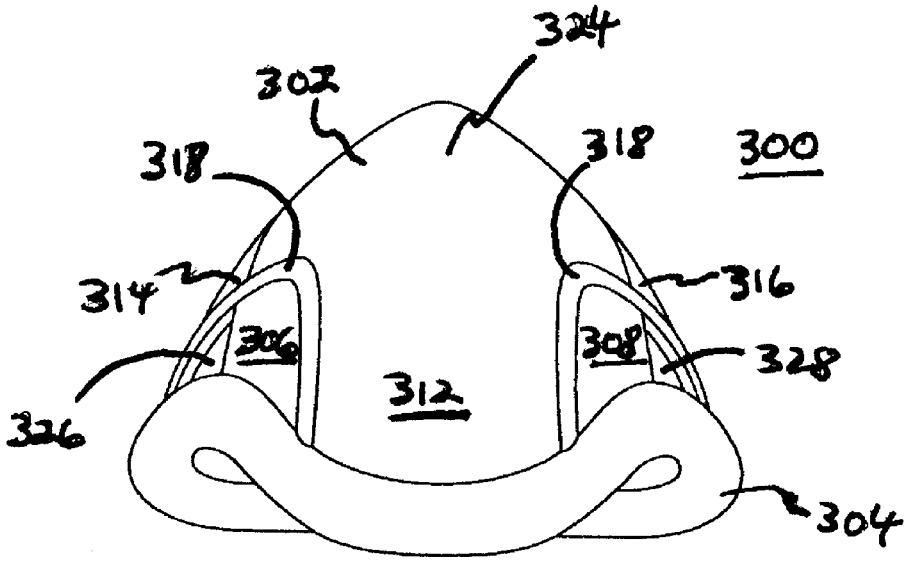
*Fig.* 17

PROTECTIVE CUP AND METHOD OF MANUFACTURING THE PROTECTIVE CUP

BACKGROUND OF THE INVENTION

1. Field of the Invention

Apparatuses and methods consistent with the present invention generally relate to a protective cup and a method of manufacturing the protective cup. The protective cup may be used, for example, in athletic and/or other activities requiring protection for the lower abdominal and/or genital area of men, women, boys, and/or girls.

2. Description of the Related Art

Protective cups have been used for many years by athletes. Traditionally, players in baseball, boxing, football, hockey, lacrosse, and rugby have used such cups to protect themselves from injury resulting from sporting contact with other players (i.e., checking or tackling) and other types of external impact (i.e., getting hit by a pitch or shot). More recently, protective cups have become important in other sports such as martial arts, mountain biking, motocross, snow skiing, waterskiing, and the like. Similarly, in fields such as professional security or the military, where interaction with protesters, suspected criminals, or terrorists may involve violent physical contact, a protective cup may make the difference between a successful and an unsuccessful interaction.

Traditional protective cups have a number of deficiencies. First, they are often bulky, restricting movement of the wearer. Second, this bulkiness often results in their being heavy and, thus, tiring to wear for an extended period. Third, they often are rigid, again restricting movement of the wearer and contributing to the wearer's discomfort. Fourth, they often have poor ventilation, exacerbating the wearer's discomfort. And fifth, some of these protective cups are fairly complex, contributing to higher manufacturing costs and sales price, as well as increased maintenance problems and shortened product life.

Therefore, there is a need for a protective cup that is simple, lightweight, compact, flexible, more comfortable, and has improved ventilation.

Illustrative, non-limiting embodiments of the present invention overcome the above disadvantages and other disadvantages not described above. However, the present invention is not required to overcome the disadvantages described above, and an illustrative, non-limiting embodiment of the present invention may not overcome any of the problems described above.

SUMMARY OF THE INVENTION

In one aspect of the present invention, a protective cup comprises a cage member and a peripheral lip. The cage member comprises an upper portion, a lower portion, and side portions. The cage member further comprises one or more substantially rigid materials. The upper portion comprises a plurality of slots, wherein each slot is oriented so that a direction defined by a largest dimension of a respective slot extends toward the lower portion. The peripheral lip is operatively connected to the upper, lower, and side portions.

In another aspect of the present invention, a protective cup comprises a cage member, a peripheral lip, and linking portions. The cage member comprises an upper portion, a lower portion, and side portions. The peripheral lip is operatively connected to the upper and lower portions and is distanced from the cage member at openings between the peripheral lip and the side portions. The linking portions operatively connect the peripheral lip to the side portions to fill the openings or one or more parts of the openings.

In yet another aspect of the present invention, a protective cup comprises a cage member, a peripheral lip, and linking portions. The cage member comprises an upper portion, a lower portion, and side portions. The upper portion comprises a plurality of slots. The peripheral lip is operatively connected to the upper and lower portions and is distanced from the cage member at openings between the peripheral lip and the side portions. The linking portions operatively connect the peripheral lip to the side portions to fill one or more parts of the openings.

In yet a further aspect of the invention, a method of manufacturing the protective cups is disclosed.

BRIEF DESCRIPTION OF THE DRAWINGS

Aspects of the present invention will become more apparent by describing in detail illustrative, non-limiting embodiments of the present invention with reference to the accompanying drawings, in which:

FIG. 16 is a top view of the protective cup of FIG. 13;

FIG. 17 is a bottom view of the protective cup of FIG. 13; and

DETAILED DESCRIPTION OF EXEMPLARY EMBODIMENTS

With reference to FIGS. 1-6, a protective cup 100 according to a first embodiment of the present invention comprises cage member 102 and peripheral lip 104.

Figure 1:
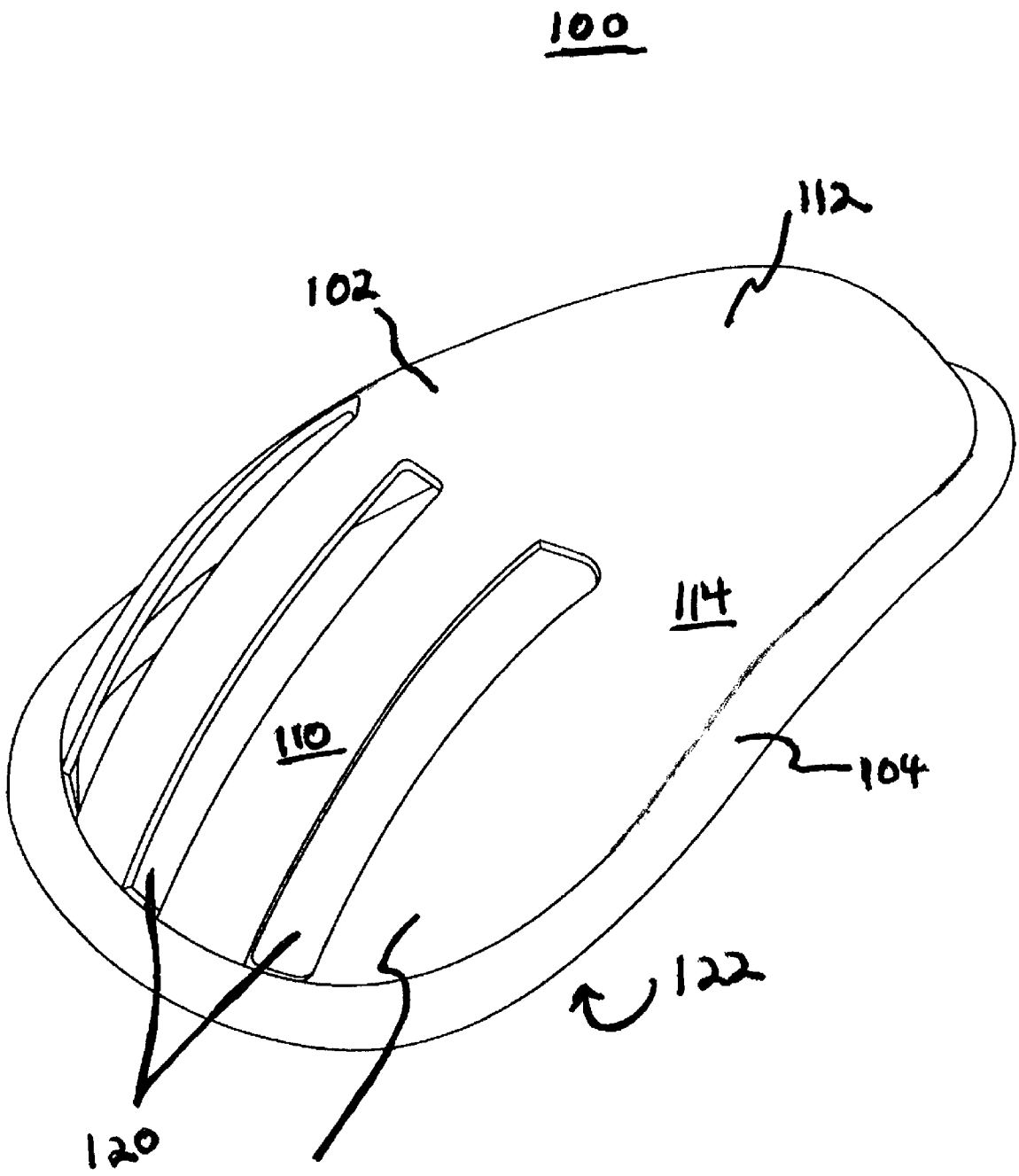
FIG. 1 is a perspective view of a first embodiment of a protective cup of the present invention.
Figure 2:
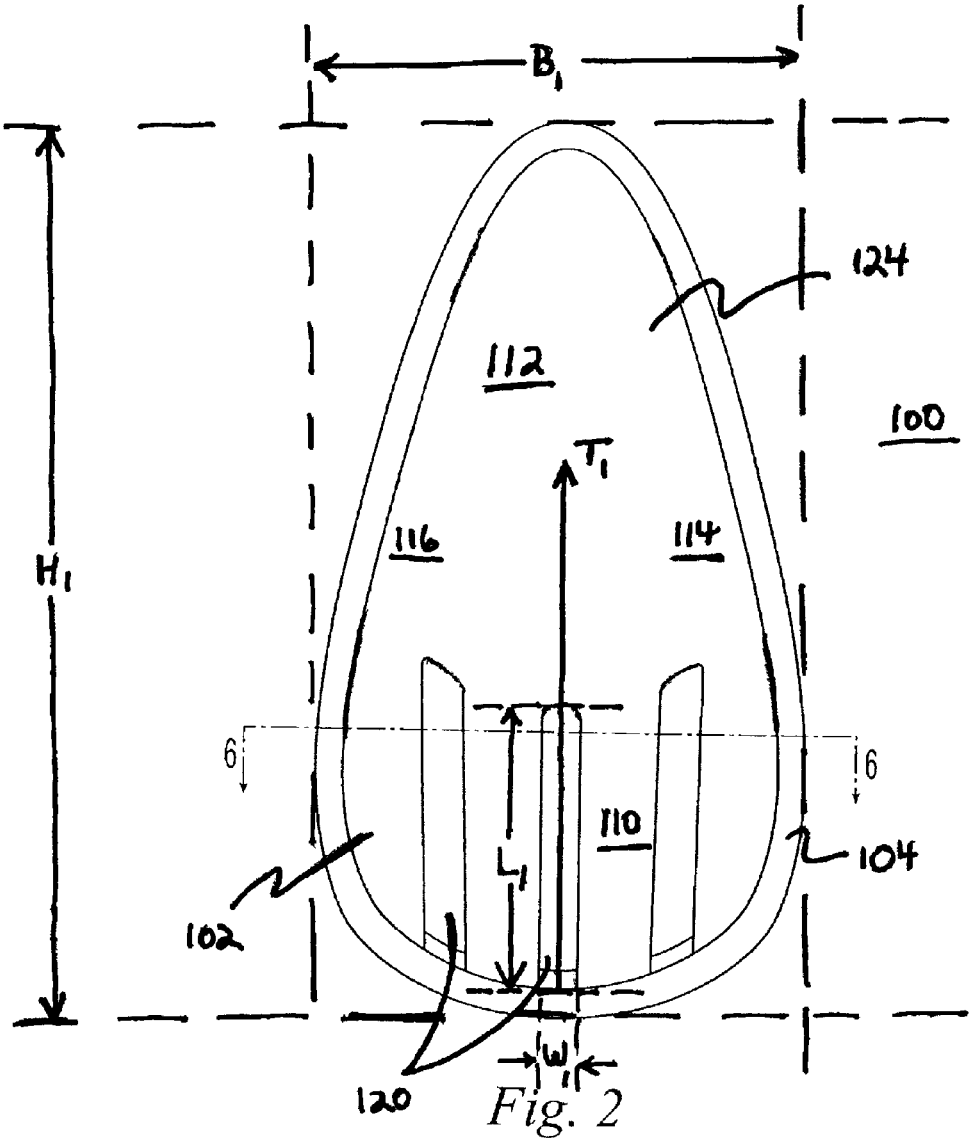
FIG. 2 is a front view of the protective cup of FIG. 1.
Figure 3:
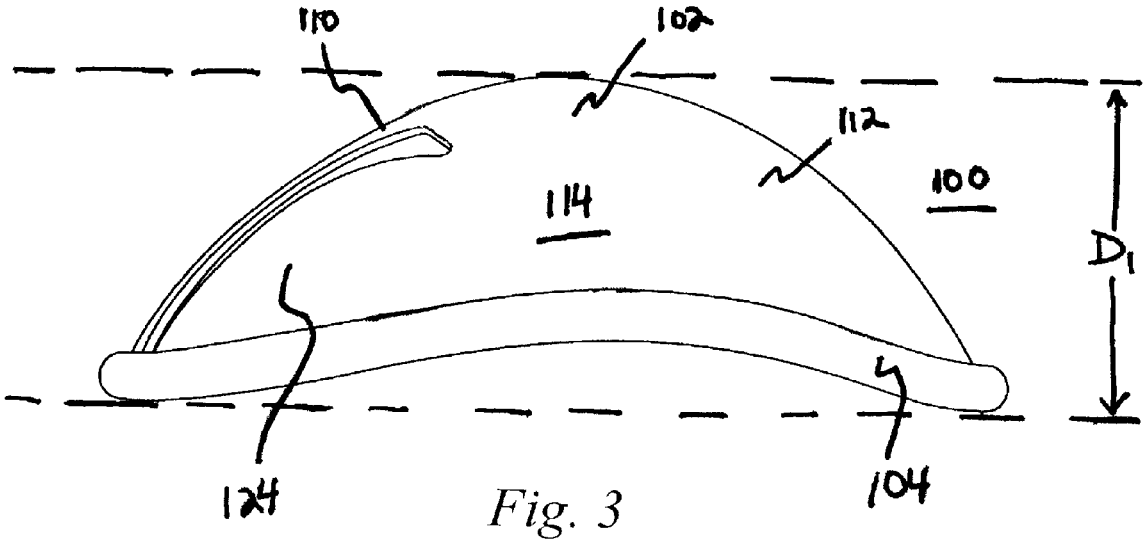
FIG. 3 is a left-side view of the protective cup of FIG. 1, the right-side view being a mirror image of the left-side view.
Figure 4:
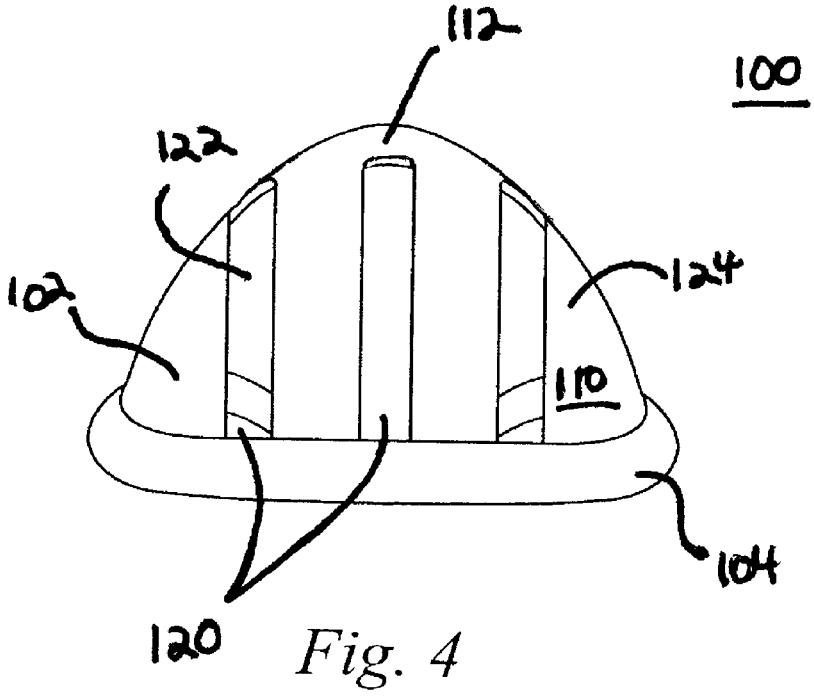
FIG. 4 is a top view of the protective cup of FIG. 1.
Figure 5:
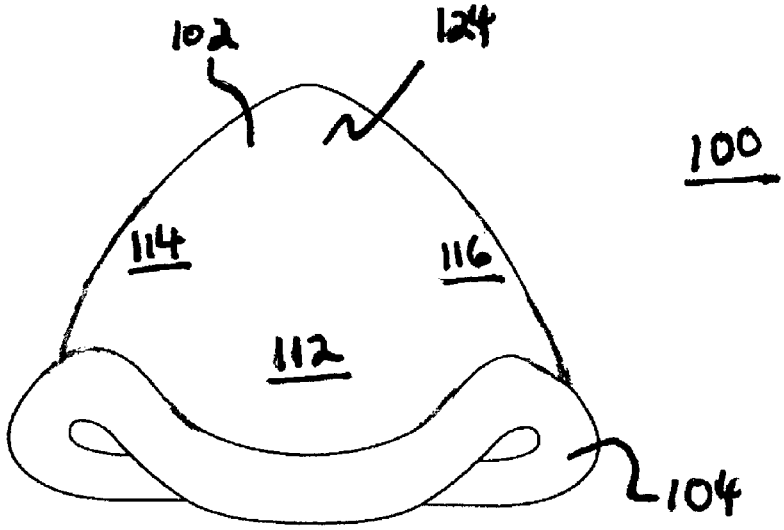
FIG. 5 is a bottom view of the protective cup of FIG. 1.
Figure 6:
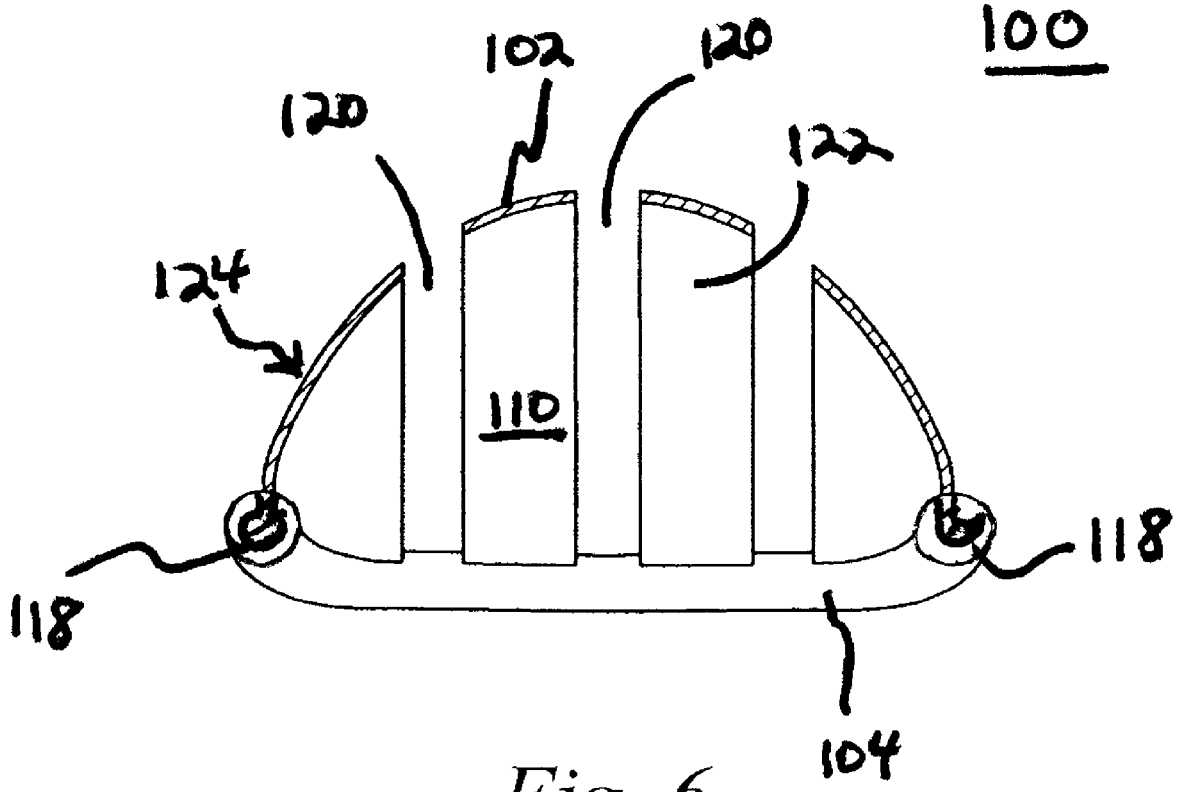
FIG. 6 is a cross-sectional view of the protective cup of FIG. 1, taken along line 6-6 in FIG. 2.
Figure 7:
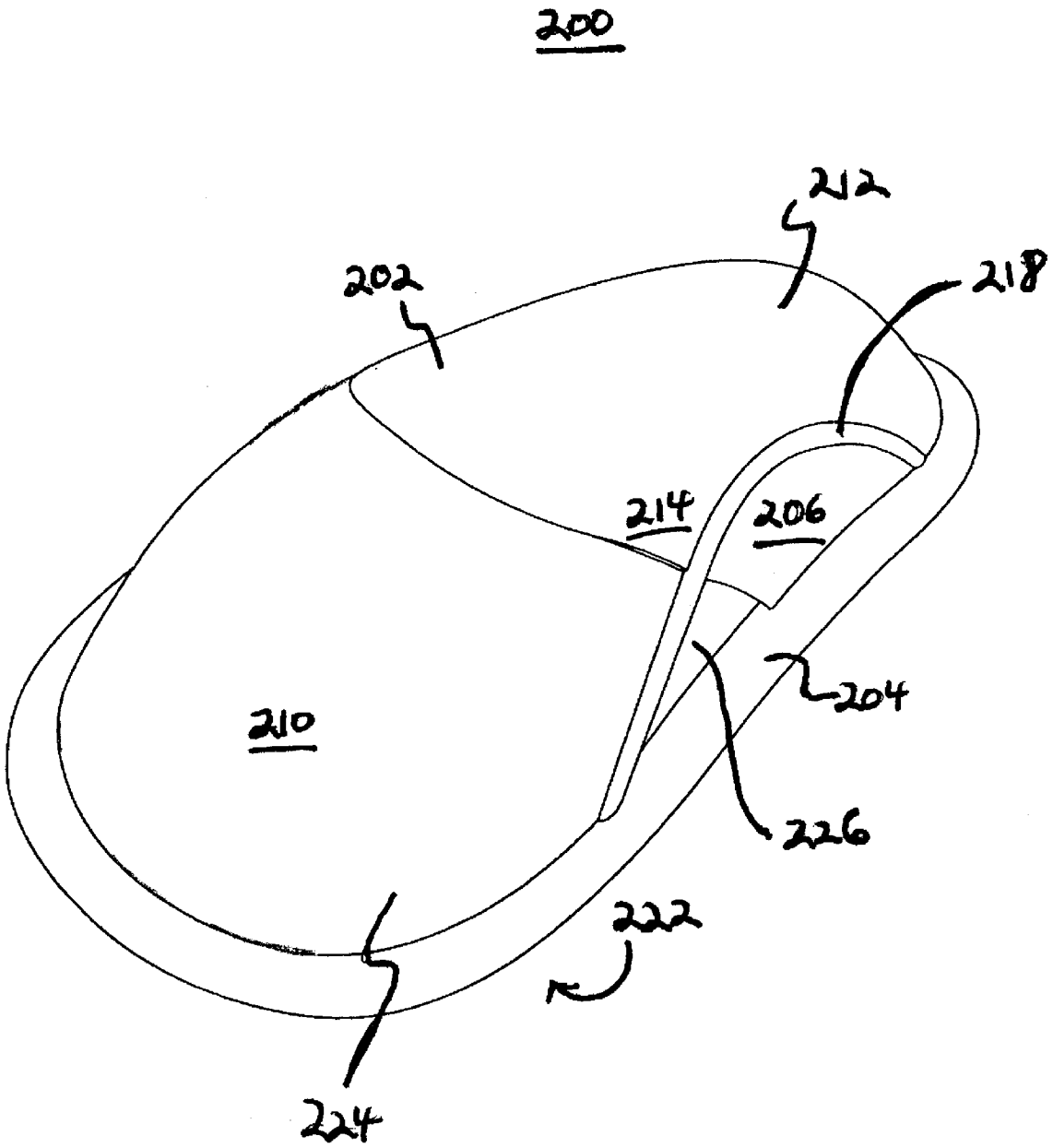
FIG. 7 is a perspective view of a second embodiment of a protective cup of the present invention.

For a proper fit, the size of protective cup 100 usually varies with the size of the user. FIGS. 2 and 3 define, for example, height $H_1$, breadth $B_1$, and depth $D_1$ for protective cup 100. Protective cup 100 may comprise, for example, a height $H_1$ greater than or equal to about 3 inches and less than or equal to about 12 inches, a breadth $B_1$ greater than or equal to about 2 inches and less than or equal to about 12 inches, and a depth $D_1$ greater than or equal to about 1 inch and less than or equal to about 6 inches; or a height $H_1$ greater than or equal to about 4 inches and less than or equal to about 8 inches, a breadth $B_1$ greater than or equal to about 3 inches and less than or equal to about 6 inches, and a depth $D_1$ greater than or equal to about 2 inches and less than or equal to about 4 inches. However, the actual values of height $H_1$, breadth $B_1$, and/or depth $D_1$ may be smaller or larger than these values if required for a specific purpose. In one embodiment, protective cup 100 comprises a height $H_1$ of about 7¼ inches, a breadth $B_1$ of about 4 inches, and a depth $D_1$ of about 2¾ inches.

As used herein, the term "about" means exactly a given value or the given value ±10%.

Cage member 102 comprises upper portion 110, lower portion 112, and side portions 114 and 116. Although protective cup 100 may have any desired shape, it may, for example, comprise a concave inner surface 122 and a convex outer surface 124 as shown, for example, in FIGS. 1-6.

Given concave inner surface 122, the center of gravity of upper portion 110 does not lie within upper portion 110. Similarly, the center of gravity of lower portion 112 does not lie within lower portion 112. Nor does the center of gravity of peripheral lip 104 lie within peripheral lip 104. As a result, the centers of gravity of upper portion 110, lower portion 112, and peripheral lip 104 all lie on the concave-inner-surface side of protective cup 100. When these three centers of gravity are non-colinear, they determine a unique plane.

Cage member 102 may further comprise an edge 118 that may extend, for example, part way or all the way around cage member 102. The cross-sectional shape of edge 118 may facilitate operatively connecting peripheral lip 104 to upper portion 110, lower portion 112, and/or side portions 114 and/or 116. Also, edge 118 may improve user safety and/or comfort by comprising, for example, one or more curved, rounded, or other cross-sections as shown, for example, in FIG. 6.

The shape of cage member 102 may be substantially symmetrical to the unique plane determined by the three centers of gravity. In addition, the shape of protective cup 100 may be substantially symmetrical to that same plane. As used herein, the term "substantially symmetrical" means symmetrical, with possible minor variations due to manufacturing tolerances and/or indicia such as manufacturing information, product identifiers, trademarks, and/or logos.

Upper portion 110 comprises a plurality of slots 120. As used in the present application, the term "slot" means an aperture comprising a non-circular shape in which a first dimension of the aperture, measured in a first direction, is at least two times larger than a second dimension of the aperture, measured in a second direction, where the second direction is approximately perpendicular to the first direction. Thus, the term "slot" would include, for example, the first dimension being at least three, four, five, six, seven, eight, nine, ten, or more times larger than the second dimension. Upper portion 110 may comprise, for example, two, three, four, five, six, seven, eight, nine, ten, or more slots 120. In one embodiment, upper portion 110 comprises three slots.

Slots 120 may be open and/or closed. That is, the associated aperture may extend into upper portion 110 from a border of upper portion 110 so that the slot is open over a portion of its periphery, or the associated aperture may lie entirely within upper portion 110 so that the slot is closed over its entire periphery. By covering the open portion of its periphery, peripheral lip 104 may effectively close otherwise open slot 120.

Slots 120 can reduce the weight, increase the flexibility, and/or improve the ventilation of cage member 102. As a result, slots 120 also can reduce the weight, increase the flexibility, improve the ventilation, and/or enhance the comfort of protective cup 100.

Slots 120 may comprise many different shapes. Slots 120 may comprise, for example, one or more shapes that approximate one or more triangles, quadrilaterals, pentagons, hexagons, and/or other polygons. Such polygons may or may not be regular polygons. However, the shape/shapes of slots 120 does/do not need to approximate one or more polygons. So, for example, slots 120 may comprise one or more shapes that approximate one or more crescents, hearts, ellipses (with sufficient eccentricity to meet the definition of the term "slot"), and/or arc sections of a circle.

Slots 120 also may comprise one or more shapes that approximate one or more letters such as, for example, "I-shaped", "L-shaped", "S-shaped", "T-shaped", "V-shaped", and/or "X-shaped". Additionally, slots 120 may comprise, for example, one or more shapes that approximate one or more trademarks, logos, and/or slogans (or outlines of the trademarks, logos, and/or slogans). Thus, slots 120 could be used to spell, for example, the name of the manufacturer of protective cup 100, a sponsor, a sport, a team, a player, a competition, and/or incorporate other potential advertising and/or marketing techniques.

At least one of slots 120 may comprise, for example, a generally rectangular shape. As used herein, the term "generally rectangular" means resembling a regular or non-regular four-sided polygon, in which: one or more of the sides may be curved; opposite sides may be parallel, substantially parallel, or generally parallel; one or more of the vertices may be rounded; and/or one or more of the vertices may form an angle greater than or equal to about 60° and less than or equal to about 120°. As used herein, the term "substantially parallel" means exactly parallel or parallel within ±10 degrees. As used herein, the term "generally parallel" means exactly parallel or parallel within ±20 degrees.

FIG. 2 defines length $L_1$ and width $W_1$ for generally rectangular slot 120. Such a generally rectangular slot 120 may comprise, for example, a length $L_1$ greater than or equal to about 1 inch and less than or equal to about 6 inches, or a length $L_1$ greater than or equal to about 2 inches and less than or equal to about 4 inches. Additionally, such a generally rectangular slot 120 may comprise, for example, a width $W_1$ greater than or equal to about ⅛ inch and less than or equal to about 1 inch, or a width $W_1$ greater than or equal to about ¼ inch and less than or equal to about ½ inch. However, the actual values of length $L_1$ and/or width $W_1$ may be smaller or larger than these values if required for a specific purpose. In one embodiment, slots 120 comprise a length $L_1$ of about 3 inches and a width $W_1$ of about ¼ inch.

If there are two slots 120, then one slot 120 may comprise a shape that is the same as or different from the other slot 120. If there are more than two slots 120, then each slot 120 may comprise a shape that is the same as or different from any or all of the other slots 120.

Slots 120 may be oriented so that a direction $T_1$ defined by a largest dimension of one of slots 120 extends toward lower portion 112 and/or side portions 114 and/or 116. In FIG. 2, for example, direction $T_1$ defined by the largest dimension of center slot 120 extends toward lower portion 112. Although not the case here, there are possible shapes of a given slot 120 in which there may be more than one such largest dimension. Also, more than one slot 120 may be oriented so that an associated direction defined by the largest dimension of the respective slot 120 extends toward lower portion 112 and/or side portions 114 and/or 116. Additionally, each slot 120 may be oriented so that an associated direction defined by the largest dimension of the respective slot 120 extends toward lower portion 112 and/or side portions 114 and/or 116.

Slots 120 may be oriented so that the largest dimension of a first slot 120 is substantially parallel to the largest dimension of at least one other slot 120. Further, slots 120 may be oriented so that the largest dimension of each slot 120 is generally parallel to the unique plane determined by the three centers of gravity. Yet further, slots 120 may be oriented so that two or more of slots 120 are parallel, substantially parallel, or generally parallel to each other.

Also, slots 120 may have other orientations. For example, slots 120 can be oriented in a fan shape, closer together near the middle of cage member 102, or a reverse fan shape, farther apart near the middle of cage member 102.

In one embodiment, protective cup 100 comprises three generally rectangular slots 120 oriented so that all three slots 120 are substantially parallel to each other and with each slot 120 comprising a length $L_1$ of about 3 inches and a width $W_1$ of about ¼ inch.

Lower portion 112 may be solid, substantially solid, or generally solid. As used herein, the term "solid" means a surface with no apertures, the term "substantially solid" means a surface with no apertures or with no more than 20% of the surface penetrated by apertures, and the term "generally solid" means a surface with no apertures or with no more than 40% of the surface penetrated by apertures.

Lower portion 112 may comprise, for example, one or more apertures of any desired shape. Such apertures can reduce the weight, increase the flexibility, and/or improve the ventilation of cage member 102. As a result, the apertures also can reduce the weight, increase the flexibility, improve the ventilation, and/or enhance the comfort of protective cup 100.

Side portions 114 and 116 may be solid, substantially solid, or generally solid. Side portions 114 and 116 may comprise, for example, one or more apertures of any desired shape. Such apertures can reduce the weight, increase the flexibility, and/or improve the ventilation of cage member 102. As a result, the apertures also can reduce the weight, increase the flexibility, improve the ventilation, and/or enhance the comfort of protective cup 100. Side portion 114 may be symmetric to side portion 116.

Although cage member 102 may comprise any desired shape, it may, for example, comprise a concave inner surface 122 and a convex outer surface 124 as shown, for example, in FIGS. 1-6. Cage member 102 may comprise a generally triangular shape as shown, for example, in FIG. 2. As used herein, the term "generally triangular" means resembling a regular or non-regular three-sided polygon, in which one or more of the sides may be curved, one or more of the vertices may be rounded, and/or one or more of the vertices may form an angle greater than or equal to about 40° and less than or equal to about 80°. Additionally, upper portion 110 may be wider than lower portion 112 as also shown, for example, in FIG. 2.

Cage member 102 comprises one or more rigid or substantially rigid materials so that cage member 102 retains its shape, to a large extent, when impacted. As used herein, the term "rigid" means: for rubbers, plastics, and other non-metallic materials that are subjected to hardness testing according to ASTM D-2240, a Shore D hardness of at least 75 according to ASTM D-2240, and for other materials, a hardness value according to a standardized method providing protection for the user equivalent to the Shore D hardness discussed in this sentence. As used herein, the term "substantially rigid" means: for rubbers, plastics, and other non-metallic materials that are subjected to hardness testing according to ASTM D-2240, a Shore D hardness of at least 60 according to ASTM D-2240, and for other materials, a hardness value according to a standardized method providing protection for the user equivalent to the Shore D hardness discussed in this sentence. Thus, the term "substantially rigid" would include, for example, rubbers, plastics, and other non-metallic materials that are subjected to hardness testing according to ASTM D-2240, a Shore D hardness of at least 65 according to ASTM D-2240.

Such rigid or substantially rigid materials may comprise, for example, polymer materials such as polypropylene, polyethylene, polybutylene terephthalate, acrylonitrile butadiene styrene ("ABS"), polycarbonate ("PC"), and ABS/PC alloys. Desired properties of the rigid or substantially rigid materials include, for example, one or more of hardness, toughness, low density (i.e., light weight), and inertness (to minimize skin irritations, rashes, etc.). As a result, the one or more rigid or substantially rigid materials could comprise, for example, at least one of: metals; natural or synthetic rubber compounds with reinforcing fibers (such as Kevlar® pulp); or Kevlar®. The one or more rigid or substantially rigid materials may incorporate advances from the nanotechnology field. In one embodiment, cage member 102 comprises one substantially rigid material, Thermoplastic Polyurethane ("TPU").

If desired, any or each of upper portion 110, lower portion 112, side portions 114 and/or 116, and edge 118 (if present) may be formed of different substantially rigid materials.

Although peripheral lip 104 may have any desired shape, it may, for example, comprise a generally tubular or cylindrical form. This form may be substantially flattened along a surface intended to directly or indirectly contact the body of the user. Additionally, the form may include a slit over at least a portion of peripheral lip 104 to facilitate operatively connecting it to upper portion 110, lower portion 112, and side portions 114 and 116. Also, peripheral lip 104 may directly contact at least part of upper portion 110, at least part of lower portion 112, and/or at least part of side portions 114 and/or 116.

Peripheral lip 104 comprises at least one resilient material that provides at least some cushioning effect when protective cup 100 is impacted. Such materials may include, for example, natural or synthetic rubber, a natural or synthetic rubber compound, polyurethane, and ethylene vinyl acetate. Desired properties of the resilient material include, for example, one or more of softness, flexibility, resilience, low density (i.e., light weight), and inertness (to minimize skin irritations, rashes, etc.). In one embodiment, the resilient material is TPU.

Cage member 102 and peripheral lip 104 may be manufactured using any suitable process known to one of skill in the art, such as, for example, extrusion, vacuum forming, or injection molding. The process may also comprise, for example, the use of adhesives or chemical bonding. Regarding cage member 102, upper portion 110 may be manufactured separately from or together with one or more of lower portion 112, side portions 114 and/or 116, and edge 118 (if present). Also, cage member 102 may be manufactured separately from or together with peripheral lip 104. Additionally, any or all of upper portion 110, lower portion 112, side portions 114 and/or 116, and edge 118 (if present) may be manufactured separately from or together with peripheral lip 104.

In one embodiment, cage member 102 (with edge 118, if present) is manufactured as a single unit by injection molding, with peripheral lip 104 added by injection molding.

With reference to FIGS. 7-12, a protective cup 200 according to a second embodiment of the present invention comprises cage member 202, peripheral lip 204, and linking portions 206 and 208.

Figure 8:
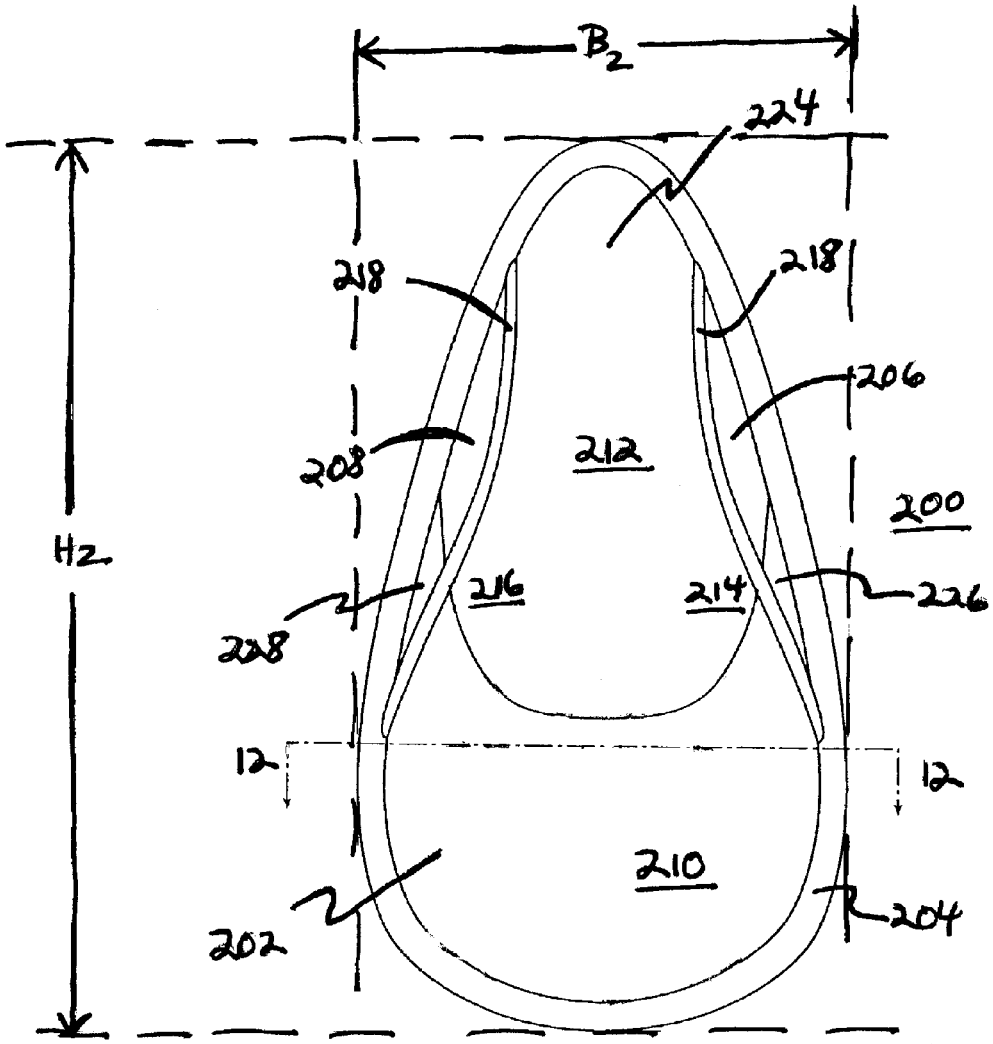
FIG. 8 is a front view of the protective cup of FIG. 7.
Figure 9:
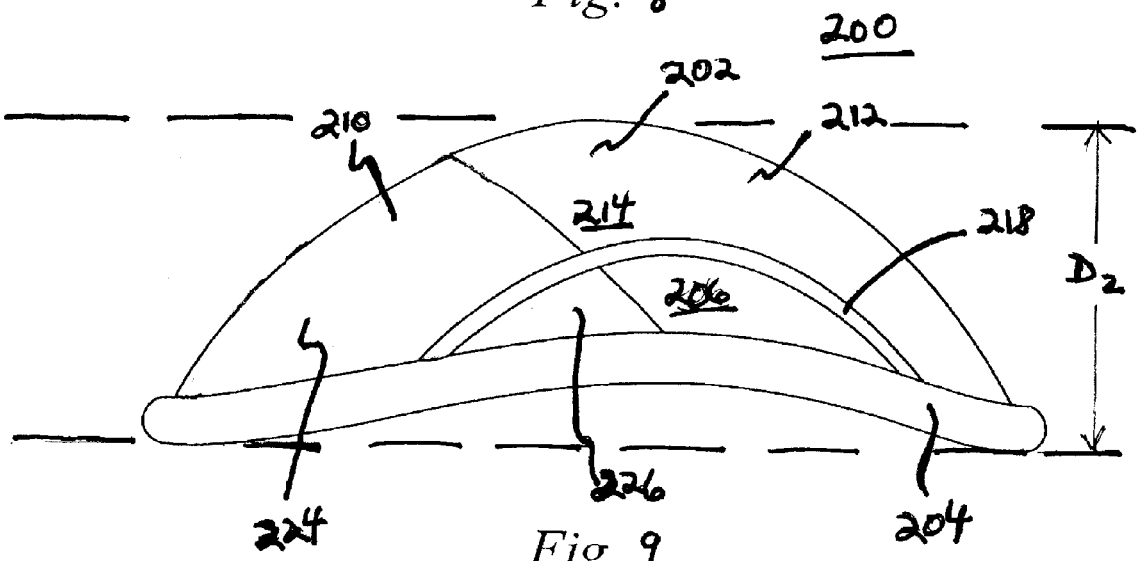
FIG. 9 is a left-side view of the protective cup of FIG. 7, the right-side view being a mirror image of the left-side view.
Figure 10:
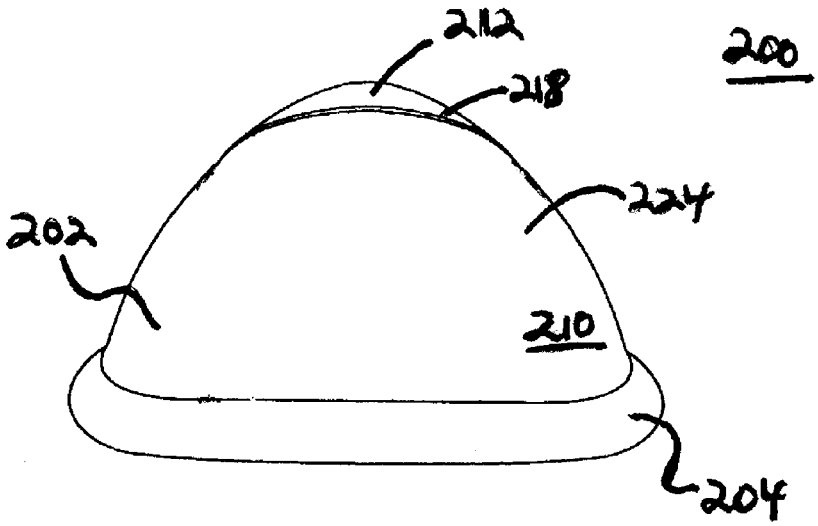
FIG. 10 is a top view of the protective cup of FIG. 7.
Figure 11:
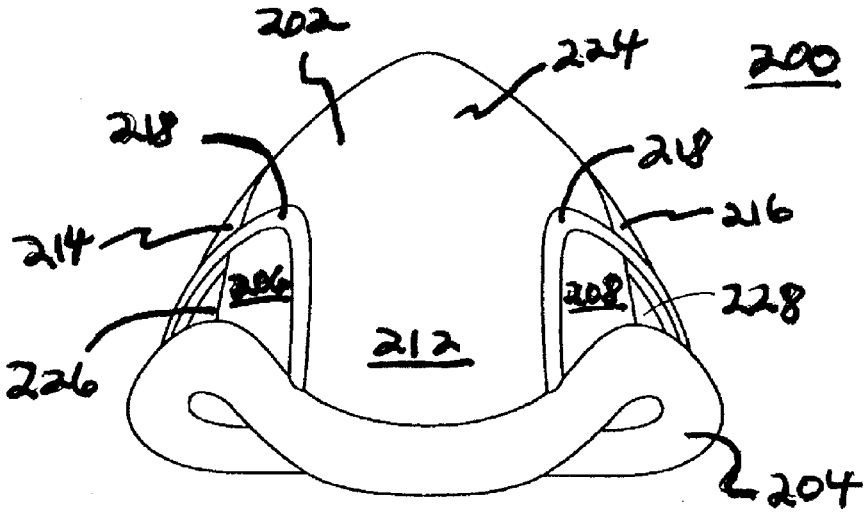
FIG. 11 is a bottom view of the protective cup of FIG. 7.
Figure 12:
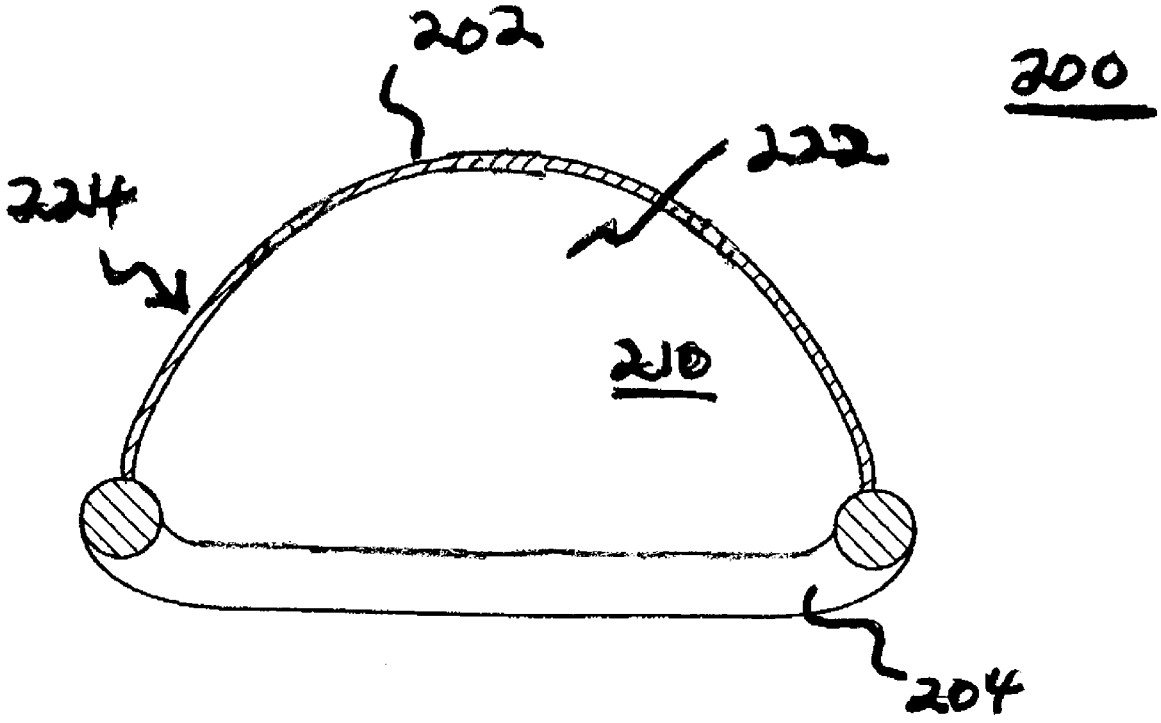
FIG. 12 is a cross-sectional view of the protective cup of FIG. 7, taken along line 12-12 in FIG. 8.
Figure 13:
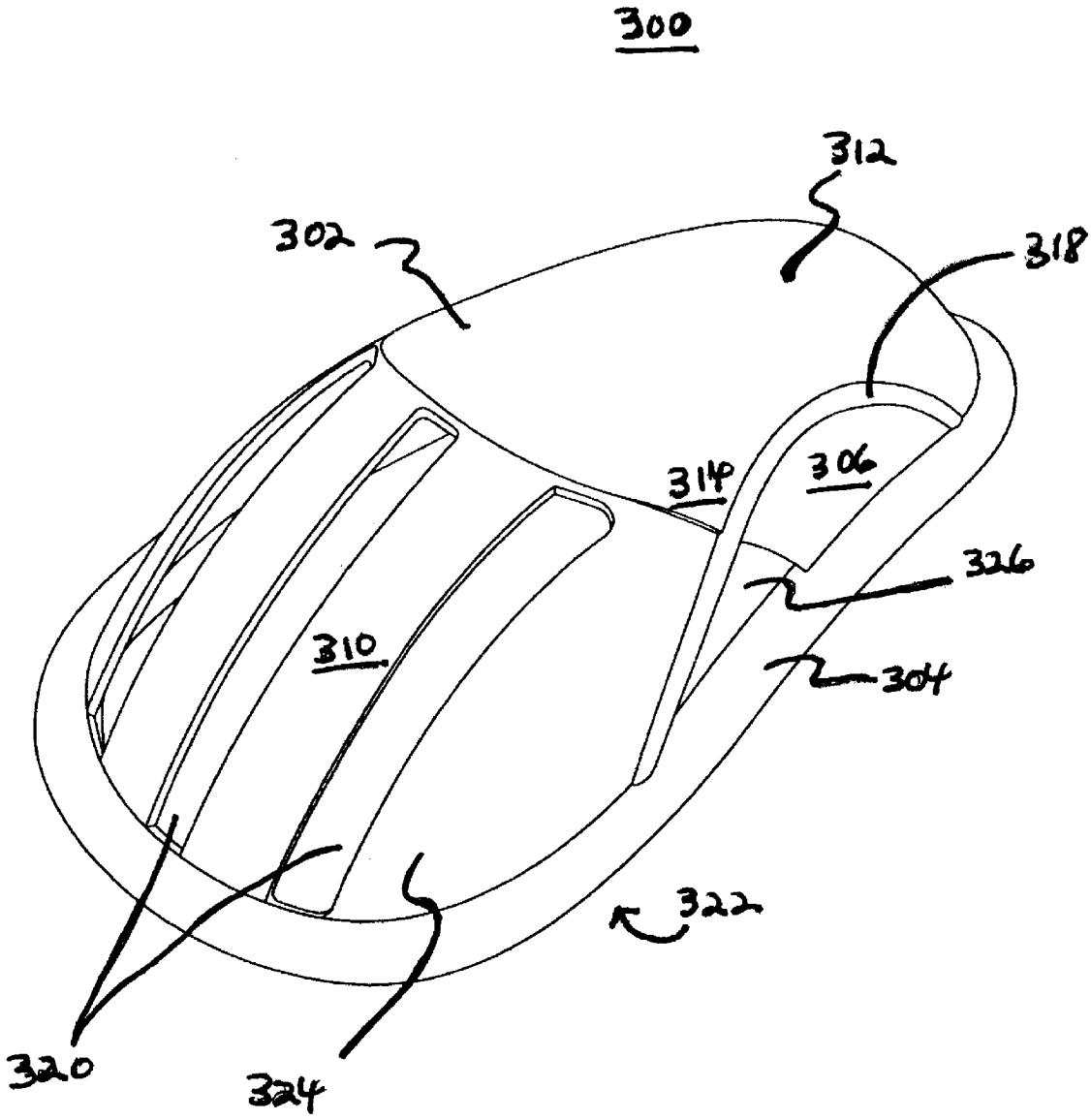
FIG. 13 is a perspective view of a third embodiment of a protective cup of the present invention.

For a proper fit, the size of protective cup 200 usually varies with the size of the user, as discussed with respect to protective cup 100. FIGS. 8 and 9 define, for example, height $H_2$, breadth $B_2$, and depth $D_2$ for protective cup 200. Protective cup 200 may comprise, for example, values of height $H_2$, breadth $B_2$, and depth $D_2$ similar to the values of height $H_1$, breadth $B_1$, and depth $D_1$ for protective cup 100.

Cage member 202 comprises upper portion 210, lower portion 212, and side portions 214 and 216. Although protective cup 200 may have any desired shape, it may, for example, comprise a concave inner surface 222 and a convex outer surface 224 as shown, for example, in FIGS. 7-12. And, as discussed with respect to protective cup 100, given concave inner surface 222, the centers of gravity of upper portion 210, lower portion 212, and peripheral lip 204 all lie on the concave-inner-surface side of protective cup 200. When these three centers of gravity are non-colinear, they determine a unique plane.

Cage member 202 may further comprise an edge 218 that may extend, for example, part way or all the way around cage member 202. The cross-sectional shape of edge 218 may facilitate operatively connecting peripheral lip 204 to upper portion 210 and/or lower portion 212. Also, edge 218 may improve user safety and/or comfort by comprising, for example, a curved or rounded cross-section.

The shape of cage member 202 may be substantially symmetrical to the unique plane determined by the three centers of gravity. In addition, the shape of protective cup 200 may be substantially symmetrical to that same plane.

Upper portion 210 may be solid, substantially solid, or generally solid. Upper portion 210 may comprise, for example, one or more apertures of any desired shape. Such apertures can reduce the weight, increase the flexibility, and/or improve the ventilation of cage member 202. As a result, the apertures also can reduce the weight, increase the flexibility, improve the ventilation, and/or enhance the comfort of protective cup 200.

Lower portion 212 may be solid, substantially solid, or generally solid. Lower portion 212 may comprise, for example, one or more apertures of any desired shape. Such apertures can reduce the weight, increase the flexibility, and/or improve the ventilation of cage member 202. As a result, the apertures also can reduce the weight, increase the flexibility, improve the ventilation, and/or enhance the comfort of protective cup 200.

Side portions 214 and 216 may be solid, substantially solid, or generally solid. Side portions 214 and 216 may comprise, for example, one or more apertures of any desired shape. Such apertures can reduce the weight, increase the flexibility, and/or improve the ventilation of cage member 202. As a result, the apertures also can reduce the weight, increase the flexibility, improve the ventilation, and/or enhance the comfort of protective cup 200. Side portion 214 may be symmetric to side portion 216.

Although cage member 202 may comprise any desired shape, it may, for example, comprise a concave inner surface 222 and a convex outer surface 224 as shown, for example, in FIGS. 7-12. Cage member 202 may comprise a generally triangular shape as shown, for example, in FIG. 8. Additionally, upper portion 210 may be wider than lower portion 212 as also shown, for example, in FIG. 8.

Cage member 202 comprises one or more rigid or substantially rigid materials so that cage member 202 retains its shape, to a large extent, when impacted. Details of the one or more rigid or substantially rigid materials parallel those discussed with respect to cage member 102. If desired, any or each of upper portion 210, lower portion 212, side portions 214 and/or 216, and edge 218 (if present) may be formed of different substantially rigid materials.

Although peripheral lip 204 may have any desired shape, it may, for example, comprise a generally tubular or cylindrical form. This form may be substantially flattened along a surface intended to directly or indirectly contact the body of the user. Additionally, the form may include a slit over at least a portion of peripheral lip 204 to facilitate operatively connecting it to upper portion 210 and lower portion 212. Also, peripheral lip 204 may directly contact at least part of upper portion 210 and/or at least part of lower portion 212.

Peripheral lip 204 is distanced from cage member 202 at opening 226 between peripheral lip 204 and side portion 214 as shown, for example, in FIG. 8. Similarly, peripheral lip 204 is distanced from cage member 202 at opening 228 between peripheral lip 204 and side portion 216 as also shown, for example, in FIG. 8. As discussed in more detail below, linking portion 206 may fill opening 226 or one or more parts of opening 226. Similarly, linking portion 208 may fill opening 228 or one or more parts of opening 228.

Peripheral lip 204 comprises at least one resilient material that provides at least some cushioning effect when protective cup 200 is impacted. Details of the at least one resilient material parallel those discussed with respect to peripheral lip 104.

Although linking portions 206 and 208 may have any desired shape, they may, for example, comprise a thin sheet operatively connecting peripheral lip 204 to respective side portion 214 or 216. As used herein, the term "linking portion" includes, on a given side of protective cup 200, one or more portions operatively connecting peripheral lip 204 to respective side portion 214 or 216.

Linking portion 206 may fill opening 226 or one or more parts of opening 226. Similarly, linking portion 208 may fill opening 228 or one or more parts of opening 228. As shown, for example, in FIG. 8, linking portion 206 may fill a lower part of opening 226, while linking portion 208 may fill a lower part of opening 228. Linking portion 206 filling the lower part of opening 226 and linking portion 208 filling the lower part of opening 228 may or may not have a fixed geometric relationship with lower portion 212.

Either or both of linking portions 206 and 208 may be solid, substantially solid, or generally solid. Apertures in linking portions 206 and/or 208 can reduce the weight, increase the flexibility, improve the ventilation, and/or enhance the comfort of protective cup 200.

Linking portions 206 and 208 comprise at least one resilient material that may provide at least some cushioning effect when protective cup 200 is impacted. Such materials may include, for example, natural or synthetic rubber, a natural or synthetic rubber compound, polyurethane, and ethylene vinyl acetate. Desired properties of the resilient material include, for example, one or more of softness, flexibility, resilience, low density (i.e., light weight), and inertness (to minimize skin irritations, rashes, etc.). In one embodiment, the resilient material is TPU.

Linking portion 206 may be formed of the same resilient material(s) as linking portion 208, or from different resilient material(s). Similarly, either or both of linking portions 206 and 208 may be made from the same resilient material as peripheral lip 204, or from a different resilient material or different resilient materials.

Cage member 202, peripheral lip 204, and linking portions 206 and 208 may be manufactured using any suitable process known to one of skill in the art, such as, for example, extrusion, vacuum forming, or injection molding. The process may also comprise, for example, the use of adhesives or chemical bonding. Regarding cage member 202, upper portion 210 may be manufactured separately from or together with one or more of lower portion 212, side portions 214 and 216, and edge 218 (if present). Also, cage member 202 may be manufactured separately from or together with one or more of peripheral lip 204 and linking portions 206 and/or 208. Additionally, any or all of upper portion 210, lower portion 212, side portions 214 and/or 216, and edge 218 (if present) may be manufactured separately from or together with one or more of peripheral lip 204 and linking portions 206 and/or 208.

In one embodiment, cage member 202 (with edge 218, if present) is manufactured as a single unit by injection molding, with peripheral lip 204 and linking portions 206 and 208 added by injection molding.

With reference to FIGS. 13-18, a protective cup 300 according to a third embodiment of the present invention comprises cage member 302, peripheral lip 304, and linking portions 306 and 308.

Figure 14:
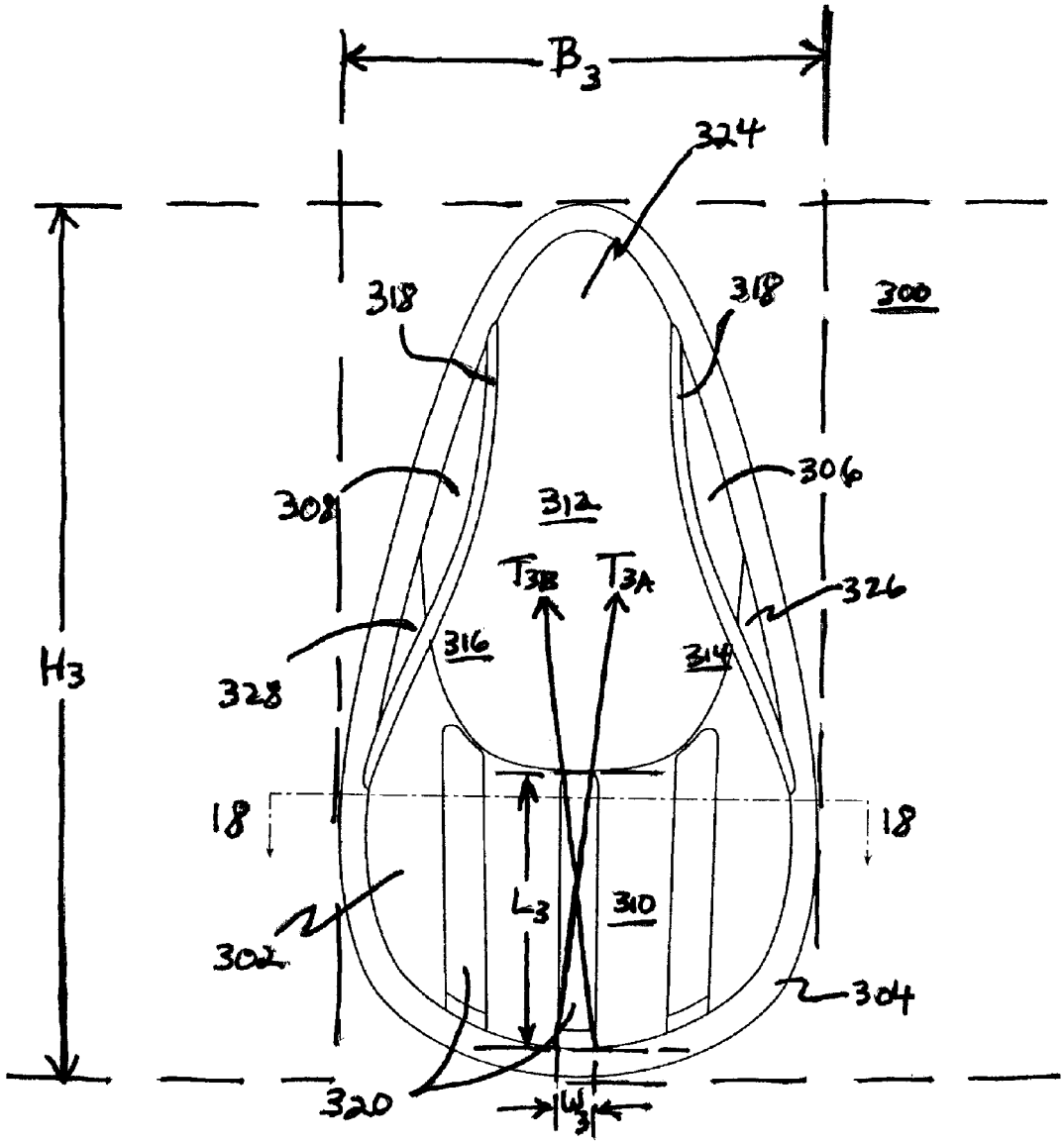
FIG. 14 is a front view of the protective cup of FIG. 13.
Figure 15:
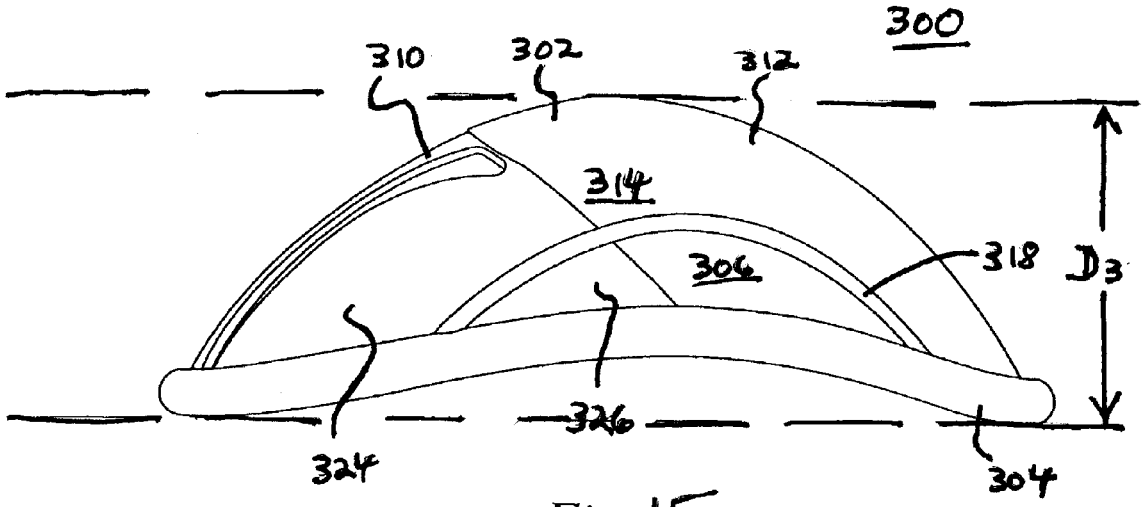
FIG. 15 is a left-side view of the protective cup of FIG. 13, the right-side view being a mirror image of the left-side view.
Figure 18:
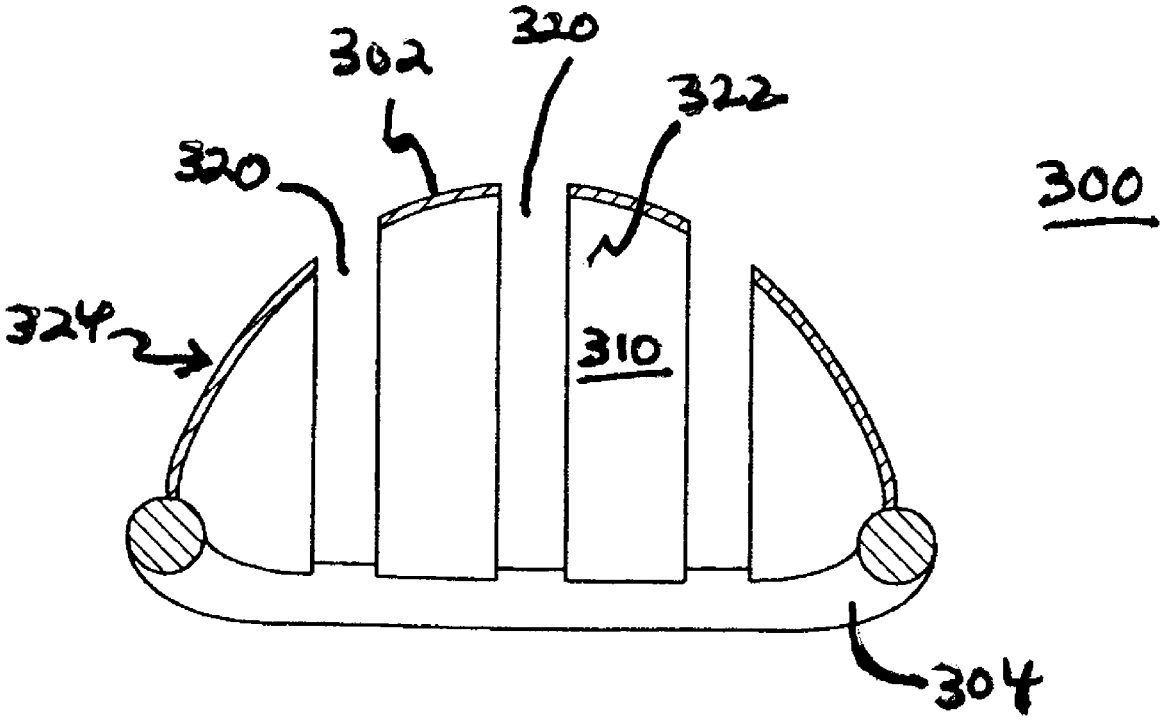
FIG. 18 is a cross-sectional view of the protective cup of FIG. 1, taken along line 18-18 in FIG. 14.

For a proper fit, the size of protective cup 300 usually varies with the size of the user, as discussed with respect to protective cup 100. FIGS. 14 and 15 define, for example, height $H_3$, breadth $B_3$, and depth $D_3$ for protective cup 300. Protective cup 300 may comprise, for example, values of height $H_3$, breadth $B_3$, and depth $D_3$ similar to the values of height $H_1$, breadth $B_1$, and depth $D_1$ for protective cup 100.

Cage member 302 comprises upper portion 310, lower portion 312, and side portions 314 and 316. Although protective cup 300 may have any desired shape, it may, for example, comprise a concave inner surface 322 and a convex outer surface 324 as shown, for example, in FIGS. 13-18. And, as discussed with respect to protective cup 100, given concave inner surface 322, the centers of gravity of upper portion 310, lower portion 312, and peripheral lip 304 all lie on the concave-inner-surface side of protective cup 300. When these three centers of gravity are non-colinear, they determine a unique plane.

Cage member 302 may further comprise an edge 318 that may extend, for example, part way or all the way around cage member 302. The cross-sectional shape of edge 318 may facilitate operatively connecting peripheral lip 304 to upper portion 310 and/or lower portion 3 12. Also, edge 318 may improve user safety and/or comfort by comprising, for example, a curved or rounded cross-section.

The shape of cage member 302 may be substantially symmetrical to the unique plane determined by the three centers of gravity. In addition, the shape of protective cup 300 may be substantially symmetrical to that same plane.

Upper portion 310 comprises a plurality of slots 320. Upper portion 310 may comprise, for example, two, three, four, five, six, seven, eight, nine, ten, or more slots 320. In one embodiment, upper portion 310 comprises three slots.

Slots 320 can reduce the weight, increase the flexibility, and/or improve the ventilation of cage member 302. As a result, slots 320 also can reduce the weight, increase the flexibility, improve the ventilation, and/or enhance the comfort of protective cup 300.

Slots 320 may comprise many different shapes. Slots 320 may comprise, for example, one or more shapes that approximate one or more triangles, quadrilaterals, pentagons, hexagons, and/or other polygons. Such polygons may or may not be regular polygons. However, the shape/shapes of slots 320 does/do not need to approximate one or more polygons. So, for example, slots 320 may comprise one or more shapes that approximate one or more crescents, hearts, ellipses (with sufficient eccentricity to meet the definition of the term "slot"), and/or arc sections of a circle.

Slots 320 also may comprise one or more shapes that approximate one or more letters such as, for example, "I-shaped", "L-shaped", "S-shaped", "T-shaped", "V-shaped", and/or "X-shaped". Additionally, slots 320 may comprise, for example, one or more shapes that approximate one or more trademarks, logos, and/or slogans (or outlines of the trademarks, logos, and/or slogans). Thus, slots 320 could be used to spell, for example, the name of the manufacturer of protective cup 300, a sponsor, a sport, a team, a player, a competition, and/or incorporate other potential advertising and/or marketing techniques.

At least one of slots 320 may comprise, for example, a generally rectangular shape. FIG. 14 defines length $L_3$ and width $W_3$ for generally rectangular slot 320. Such a generally rectangular slot 320 may comprise, for example, a length $L_3$ greater than or equal to about 1 inch and less than or equal to about 6 inches, or a length $L_3$ greater than or equal to about 2 inches and less than or equal to about 4 inches. Additionally, such a generally rectangular slot 320 may comprise, for example, a width $W_3$ greater than or equal to about ⅛ inch and less than or equal to about 1 inch, or a width $W_3$ greater than or equal to about ¼ inch and less than or equal to about ½ inch. However, the actual values of length $L_3$ and/or width $W_3$ may be smaller or larger than these values if required for a specific purpose. In one embodiment, slots 320 comprise a length $L_3$ of about 3 inches and a width $W_3$ of about ¼ inch.

If there are two slots 320, then one slot 320 may comprise a shape that is the same as or different from the other slot 320. If there are more than two slots 320, then each slot 320 may comprise a shape that is the same as or different from any or all of the other slots 320.

Slots 320 may be oriented so that a direction $T_3$ defined by a largest dimension of one of slots 320 extends toward lower portion 312 and/or side portions 314 and/or 316. In FIG. 14, for example, direction $T_3$ defined by the largest dimension of center slot 320 extends toward lower portion 312 and/or side portions 314 and/or 316. As previously discussed, there are possible shapes of a given slot 320 in which there may be more than one such largest dimension. As is the case here, for example, there are two such largest dimensions ($T_{3A}$ and $T_{3B}$) and, although not required by the present invention, both directions $T_{3A}$ and $T_{3B}$ extend toward lower portion 312 and/or side portions 314 and/or 316. As shown in FIG. 14, for example, direction $T_{3A}$ extends toward lower portion 312 and/or side portion 314, while direction $T_{3B}$ extends toward lower portion 312 and/or side portion 316.

Also, more than one slot 320 may be oriented so that an associated direction defined by the largest dimension of the respective slot 320 extends toward lower portion 312. Additionally, each slot 320 may be oriented so that an associated direction defined by the largest dimension of the respective slot 320 extends toward lower portion 312.

Slots 320 may be oriented so that the largest dimension of a first slot 320 is substantially parallel to the largest dimension of at least one other slot 320. Further, slots 320 may be oriented so that the largest dimension of each slot 320 is generally parallel to the unique plane determined by the three centers of gravity. Yet further, slots 320 may be oriented so that two or more of slots 320 are parallel, substantially parallel, or generally parallel to each other.

Also, slots 320 may have other orientations. For example, slots 320 can be oriented in a fan shape, closer together near the middle of cage member 302, or a reverse fan shape, farther apart near the middle of cage member 302.

In one embodiment, protective cup 300 comprises three generally rectangular slots 320 oriented so that all three slots 320 are substantially parallel to each other and with each slot 320 comprising a length $L_3$ of about 3 inches and a width $W_3$ of about ¼ inch.

Lower portion 312 may be solid, substantially solid, or generally solid. Lower portion 312 may comprise, for example, one or more apertures of any desired shape. Such apertures can reduce the weight, increase the flexibility, and/or improve the ventilation of cage member 302. As a result, the apertures also can reduce the weight, increase the flexibility, improve the ventilation, and/or enhance the comfort of protective cup 300.

Side portions 314 and 316 may be solid, substantially solid, or generally solid. Side portions 314 and 316 may comprise, for example, one or more apertures of any desired shape. Such apertures can reduce the weight, increase the flexibility, and/or improve the ventilation of cage member 302. As a result, the apertures also can reduce the weight, increase the flexibility, improve the ventilation, and/or enhance the comfort of protective cup 300. Side portion 314 may be symmetric to side portion 316.

Although cage member 302 may comprise any desired shape, it may, for example, comprise a concave inner surface 322 and a convex outer surface 324 as shown, for example, in FIGS. 13-18. Cage member 302 may comprise a generally triangular shape as shown, for example, in FIG. 14. Additionally, upper portion 310 may be wider than lower portion 312 as also shown, for example, in FIG. 14.

Cage member 302 comprises one or more rigid or substantially rigid materials so that cage member 302 retains its shape, to a large extent, when impacted. Details of the one or more rigid or substantially rigid materials parallel those discussed with respect to cage member 102. If desired, any or each of upper portion 310, lower portion 312, side portions 314 and/or 316, and edge 318 (if present) may be formed of different substantially rigid materials.

Although peripheral lip 304 may have any desired shape, it may, for example, comprise a generally tubular or cylindrical form. This form may be substantially flattened along a surface intended to directly or indirectly contact the body of the user. Additionally, the form may include a slit over at least a portion of peripheral lip 304 to facilitate operatively connecting it to upper portion 310 and lower portion 312. Also, peripheral lip 304 may directly contact at least part of upper portion 310 and/or at least part of lower portion 312.

Peripheral lip 304 is distanced from cage member 302 at opening 326 between peripheral lip 304 and side portion 314 as shown, for example, in FIG. 14. Similarly, peripheral lip 304 is distanced from cage member 302 at opening 328 between peripheral lip 304 and side portion 316 as also shown, for example, in FIG. 14. As discussed in more detail below, linking portion 306 may fill opening 326 or one or more parts of opening 326. Similarly, linking portion 308 may fill opening 328 or one or more parts of opening 328.

Peripheral lip 304 comprises at least one resilient material that provides at least some cushioning effect when protective cup 300 is impacted. Details of the at least one resilient material parallel those discussed with respect to peripheral lip 104.

Although linking portions 306 and 308 may have any desired shape, they may, for example, comprise a thin sheet operatively connecting peripheral lip 304 to respective side portion 314 or 316.

Linking portion 306 may fill opening 326 or one or more parts of opening 326. Similarly, linking portion 308 may fill opening 328 or one or more parts of opening 328. As shown, for example, in FIG. 14, linking portion 306 may fill a lower part of opening 326, while linking portion 308 may fill a lower part of opening 328. Linking portion 306 filling the lower part of opening 326 and linking portion 308 filling the lower part of opening 328 may or may not have a fixed geometric relationship with lower portion 312.

Either or both of linking portions 306 and 308 may be solid, substantially solid, or generally solid. Apertures in linking portions 306 and/or 308 can reduce the weight, increase the flexibility, improve the ventilation, and/or enhance the comfort of protective cup 300.

Linking portions 306 and 308 comprise at least one resilient material that may provide at least some cushioning effect when protective cup 300 is impacted. Details of the at least one resilient material parallel those discussed with respect to linking portions 206 and 208. Linking portion 306 may be formed of the same resilient material(s) as linking portion 308, or from different resilient material(s). Similarly, either or both of linking portions 306 and 308 may be made from the same resilient material as peripheral lip 304, or from a different resilient material or different resilient materials.

Cage member 302, peripheral lip 304, and linking portions 306 and 308 may be manufactured using any suitable process known to one of skill in the art, such as, for example, extrusion, vacuum forming, or injection molding. The process may also comprise, for example, the use of adhesives or chemical bonding. Regarding cage member 302, upper portion 310 may be manufactured separately from or together with one or more of lower portion 312, side portions 314 and/or 316, and edge 318 (if present). Also, cage member 302 may be manufactured separately from or together with one or more of peripheral lip 304 and linking portions 306 and/or 308. Additionally, any or all of upper portion 310, lower portion 312, side portions 314 and/or 316, and edge 318 (if present) may be manufactured separately from or together with one or more of peripheral lip 304 and linking portions 306 and/or 308.

In one embodiment, cage member 302 (with edge 318, if present) is manufactured as a single unit by injection molding, with peripheral lip 304 and linking portions 306 and 308 added by injection molding.

In the present application, when a numerical limit or range is stated, the endpoints are included. Also, all values and sub-ranges within a numerical limit or range are specifically included as if explicitly written out.

The above description is presented to enable a person skilled in the art to make and use the invention, and is provided in the context of a particular application and its requirements. It is contemplated that numerous modifications to the exemplary embodiments should be readily apparent to those skilled in the art and that the generic principles defined herein may be applied to other embodiments and applications without departing from the spirit and scope of the embodiments of the present invention as defined in the following claims. Thus, the present invention is not intended to be limited to the embodiments disclosed, but is to be accorded the widest scope consistent with the principles and features disclosed herein.

What is claimed is:

1. A protective cup, comprising:

a cage member; and a peripheral lip connected to the cage member, the peripheral lip and the cage member configured as a protective athletic cup for protecting the genital area of a human wearer;

wherein the cage member comprises:

an upper portion;

a lower portion; and side portions;

wherein the cage member further comprises one or more substantially rigid materials, wherein the upper portion comprises a plurality of slots, wherein at least one slot is oriented so that a direction defined by a largest dimension of the at least one slot extends toward the lower portion, and wherein the peripheral lip is operatively connected to the upper, lower, and side portions.

2. The protective cup of claim 1, wherein a shape of the cage member is substantially symmetrical to a plane passing through:

a center of gravity of the upper portion;

a center of gravity of the lower portion; and a center of gravity of the peripheral lip.

3. The protective cup of claim 1, wherein a shape of the protective cup is substantially symmetrical to a plane passing through:

a center of gravity of the upper portion;

a center of gravity of the lower portion; and a center of gravity of the peripheral lip.

4. The protective cup of claim 1, wherein the cage member comprises an outer surface, and wherein the outer surface comprises a convex shape.

5. The protective cup of claim 1, wherein the cage member comprises an inner surface, and wherein the inner surface comprises a concave shape.

6. The protective cup of claim 1, wherein the cage member comprises a generally triangular shape.

7. The protective cup of claim 1, wherein a breadth of the upper portion is greater than a breadth of the lower portion.

8. The protective cup of claim 1, wherein the lower portion is substantially solid.

9. The protective cup of claim 1, wherein at least one of the slots comprises a generally rectangular shape.

10. The protective cup of claim 1, wherein the slots are oriented so that the largest dimension of a first slot is generally parallel to the largest dimension of at least one other slot.

11. The protective cup of claim 1, wherein the slots are oriented so that the largest dimension of each slot is generally parallel to a plane passing through:

a center of gravity of the upper portion;

a center of gravity of the lower portion; and a center of gravity of the peripheral lip.

12. The protective cup of claim 1, wherein the peripheral lip comprises a resilient material.

13. A method of manufacturing a protective cup, comprising:

producing a cage member that comprises an upper portion, a lower portion, and side portions; and operatively connecting a peripheral lip to the upper, lower, and side portions;

wherein the cage member further comprises one or more substantially rigid materials, wherein the upper portion comprises a plurality of slots, and wherein at least one slot is oriented so that a direction defined by a largest dimension of the at least one slot extends toward the lower portion.

14. The method of claim 13, wherein the peripheral lip comprises a resilient material.

15. A protective cup made by the method of claim 13.

16. A protective cup, comprising:

a cage member;

a peripheral lip; and linking portions positioned between the cage member and the peripheral lip, wherein the cage member, peripheral lip, and linking portions non-removably connected together;

wherein the cage member comprises:

an upper portion;

a lower portion; and side portions;

wherein the peripheral lip is operatively connected to the upper and lower portions, wherein the peripheral lip is distanced from the cage member at openings between the peripheral lip and the side portions, and wherein the linking portions operatively connect the peripheral lip to the side portions to fill one or more parts of the openings.

17. The protective cup of claim 16, wherein the cage member further comprises one or more substantially rigid materials.

18. The protective cup of claim 16, wherein a shape of the cage member is substantially symmetrical to a plane passing through:

a center of gravity of the upper portion;

a center of gravity of the lower portion; and a center of gravity of the peripheral lip.

19. The protective cup of claim 16, wherein a shape of the protective cup is substantially symmetrical to a plane passing through:

a center of gravity of the upper portion;

a center of gravity of the lower portion; and a center of gravity of the peripheral lip.

20. The protective cup of claim 16, wherein the cage member comprises an outer surface, and wherein the outer surface comprises a convex shape.

21. The protective cup of claim 16, wherein the cage member comprises an inner surface, and wherein the inner surface comprises a concave shape.

22. The protective cup of claim 16, wherein the cage member comprises a generally triangular shape.

23. The protective cup of claim 16, wherein a breadth of the upper portion is greater than a breadth of the lower portion.

24. The protective cup of claim 16, wherein the upper portion is substantially solid.

25. The protective cup of claim 16, wherein the lower portion is substantially solid.

26. The protective cup of claim 16, wherein the upper portion is substantially solid, and wherein the lower portion is substantially solid.

27. The protective cup of claim 16, wherein the linking portions operatively connect the peripheral lip to the side portions to fill lower parts of the openings.

28. The protective cup of claim 16, wherein the peripheral lip and the linking portions comprise a resilient material.

29. The protective cup of claim 16, wherein the peripheral lip comprises a first resilient material.

30. The protective cup of claim 16, wherein the linking portions comprise a second resilient material.

31. The protective cup of claim 16, wherein the upper portion and lower portion of the cage member comprise a substantially rigid material, wherein the peripheral lip comprises a first resilient material, and wherein the linking portions comprise a second resilient material.

32. The protective cup of claim 16, wherein the linking portions are substantially solid.

33. The protective cup of claim 16, wherein the linking portions are generally solid.

34. A method of manufacturing a protective cup, comprising:

producing a cage member that comprises an upper portion, a lower portion, and side portions;

operatively connecting a peripheral lip to the upper and lower portions; and using linking portions to operatively connect the peripheral lip to the side portions;

wherein the peripheral lip is distanced from the cage member at openings between the peripheral lip and the side portions, wherein the linking portions operatively connect the peripheral lip to the side portions to fill one or more parts of the openings; and wherein the cage member, peripheral lip and linking portions are non-removably molded together to form a unitary part.

35. The method of claim 34, wherein the linking portions operatively connect the peripheral lip to the side portions to fill lower parts of the openings.

36. The method of claim 34, wherein the peripheral lip and the linking portions comprise a resilient material.

37. The method of claim 34, wherein the peripheral lip comprises a first resilient material.

38. The method of claim 34, wherein the linking portions comprise a second resilient material.

39. The method of claim 34, wherein the peripheral lip comprises a first resilient material, and wherein the linking portions comprise a second resilient material.

40. The method of claim 34, wherein the linking portions are substantially solid.

41. The method of claim 34, wherein the linking portions are generally solid.

42. A protective cup made by the method of claim 34.

43. A protective cup, comprising:

a cage member;

a peripheral lip; and linking portions, wherein the cage member, peripheral lip and linking portions are non-removably connected together;

wherein the cage member comprises:

an upper portion;

a lower portion; and side portions;

wherein the upper portion comprises a plurality of slots, wherein the peripheral lip is operatively connected to the upper and lower portions, wherein the peripheral lip is distanced from the cage member at openings between the peripheral lip and the side portions, wherein the linking portions operatively connect the peripheral lip to the side portions to fill one or more parts of the openings, and wherein the linking portions are comprised of a substantially resilient material and the cage member is comprised of a substantially rigid material.

44. A method of manufacturing a protective cup, comprising:

producing a cage member that comprises an upper portion, a lower portion, and side portions;

operatively connecting a peripheral lip to the upper and lower portions; and using linking portions to operatively connect the peripheral lip to the side portions;

wherein the upper portion comprises a plurality of slots, wherein the peripheral lip is distanced from the cage member at openings between the peripheral lip and the side portions, wherein the linking portions operatively connect the peripheral lip to the side portions to fill one or more parts of the openings, and wherein the linking portions are comprised of a substantially resilient material and the cage member is comprised of a substantially rigid material.

45. The method of claim 44, wherein the linking portions operatively connect the peripheral lip to the side portions to fill lower parts of the openings.

46. A protective cup made by the method of claim 44.

* * * * *